US005431194A

United States Patent [19]

Steiner et al.

[11] Patent Number: 5,431,194

[45] Date of Patent: Jul. 11, 1995

[54] SERIES SHED LOOM

[75] Inventors: Alois Steiner, Rieden; Sandro Trecco, Rüti, both of Switzerland

[73] Assignee: Sulzer Rueti AG, Rueti, Switzerland

[21] Appl. No.: 241,955

[22] Filed: May 12, 1994

Related U.S. Application Data

[63] Continuation of Ser. No. 60,565, May 12, 1993, abandoned.

[30] Foreign Application Priority Data

May 15, 1992 [EP] European Pat. Off. ..... 92810368

[51] Int. Cl.[6] ..... D03D 41/00

[52] U.S. Cl. ..... 139/28; 139/11

[58] Field of Search ..... 139/28, 11

[56] References Cited

U.S. PATENT DOCUMENTS

| | | | |
|---|---|---|---|
| 4,290,458 | 9/1981 | Steiner | 139/28 |
| 4,498,501 | 2/1985 | Steiner | 139/28 |
| 4,531,553 | 7/1985 | Steiner | 139/28 |
| 5,174,341 | 12/1992 | Steiner et al. | 139/28 |
| 5,188,154 | 2/1993 | Christe et al. | 139/28 |

FOREIGN PATENT DOCUMENTS

| | | |
|---|---|---|
| 0093078 | 11/1983 | European Pat. Off. . |
| 0196349 | 10/1986 | European Pat. Off. . |
| 0456599 | 11/1991 | European Pat. Off. . |
| 543621 | 12/1973 | Switzerland . |

*Primary Examiner*—Andrew M. Falik

*Attorney, Agent, or Firm*—Townsend and Townsend, Khourie and Crew

[57] ABSTRACT

A series-shed loom for weaving a fabric from warp threads and weft threads. The loom has a rotor with reeds that comb through the warp threads and carries guide elements which define high points and low points. A multiplicity of elongated laying elements oriented parallel to the axis of rotation of the rotor guide the warp threads towards the rotor and insert them in the high and low points of the guide elements thereon. The laying elements are spaced from the rotor surface, they have a width in the direction of rotation, and warp threads which are adjacent in the fabric are guided over laying elements which are separated from each other by a pitch of at least twice the pitch between adjacent laying elements so that a point of intersection between the warp threads which are adjacent in the fabric is moved relatively further away from the laying elements and so that the point of intersection is further moved closer towards the rotor.

10 Claims, 5 Drawing Sheets

SERIES SHED LOOM

This is a Continuation of application Ser. No. 08/060,565, filed May 12, 1993, now abandoned.

BACKGROUND OF THE INVENTION

The invention relates to a series-shed loom including a rotor having reeds which comb through the warp threads. The warp threads are inserted by laying elements in shedding high and low points of guide elements in the direction of rotation right up to a beater bar. The laying elements are spaced apart from the reeds.

From EP 0 456 599 is known a series-shed loom having a shedding rotor, into which picks are inserted. The rotor is covered with shedding guide elements and with reeds, into which laying elements lay in warp threads by displacement at right angles to the direction of rotation. During shedding the majority of warp threads experience an excursion at right angles to the direction of rotation, which is not stopped until the removal of the guide elements before the beat up, so that the warp threads are newly straightened. The warp threads partially overlap adjacent the rotor. During the laying-in of the warp threads by the reverse movement of the laying elements there is the danger that two crossing warp threads touch at a point of intersection and are obstructed by the mutual friction, with the result that the two warp threads no longer extend in the stretched condition but at the point of contact have an additional bending point and are therefore no longer in the planned position. Another danger is that the warp threads are not inserted as planned into the shedding high and low points of the rotor and/or that the warp threads can not be combed out as planned and therefore skip the reed. Errors are produced in the fabric because of the warp threads not being inserted in the rotor in the way planned. Furthermore, during the laying-in operation there is the danger that the warp threads, which can be moved by laying elements at right angles to the direction of rotation, are laid in the guide elements as planned and are guided by the guide elements in the transverse direction, but that further transverse movements of the warp threads under some circumstances cause a slanting-off so that the warp threads can not be combed out and therefore skip the reed.

SUMMARY OF THE INVENTION

The invention offers a remedy to these problems. The object of the invention is to avoid trouble during the laying-in operation of the warp threads into the shedding high and low points of the guide elements, which is caused by contact between crossing warp threads or by warp threads skipping over the reed. The object is achieved according to the invention forwardly displacing a point of intersection of adjacent warp threads in a fabric. The point of intersection is forwardly displaced by providing a minimum pitch between the laying elements or by assigning adjacent warp threads to laying elements in an appropriate manner so that the minimum pitch is provided which cross directly in front of the reeds being inserted, have a point of intersection forwardly displaced in the direction of rotation; and means for ensuring, for a warp repeat, that the laying elements of the adjacent warp threads have a minimum pitch by assigning of the warp threads to the laying elements in a manner which provides said minimum pitch or by increasing a spacing between the laying elements.

The advantages of the invention are regarded as being that, apart from a reduction in fabric errors, fabrics with smaller warp thread spacings or higher number of threads in the warp can also be produced, and that warp threads experience less stress and thus even threads having a greater surface roughness, e.g. threads made from staple fibre material, can be processed. The fact that the area of the angle of rotation of the rotor, inside which the warp threads could again jump out of the guide elements because of slanting-off, is reduced also has an advantageous effect. Therefore between two guide elements a larger area for the angle of rotation is produced, inside which the laying elements can move the warp threads in the transverse direction without the risk of skipping.

DESCRIPTION OF THE PREFERRED EMBODIMENTS

Figure 1A:
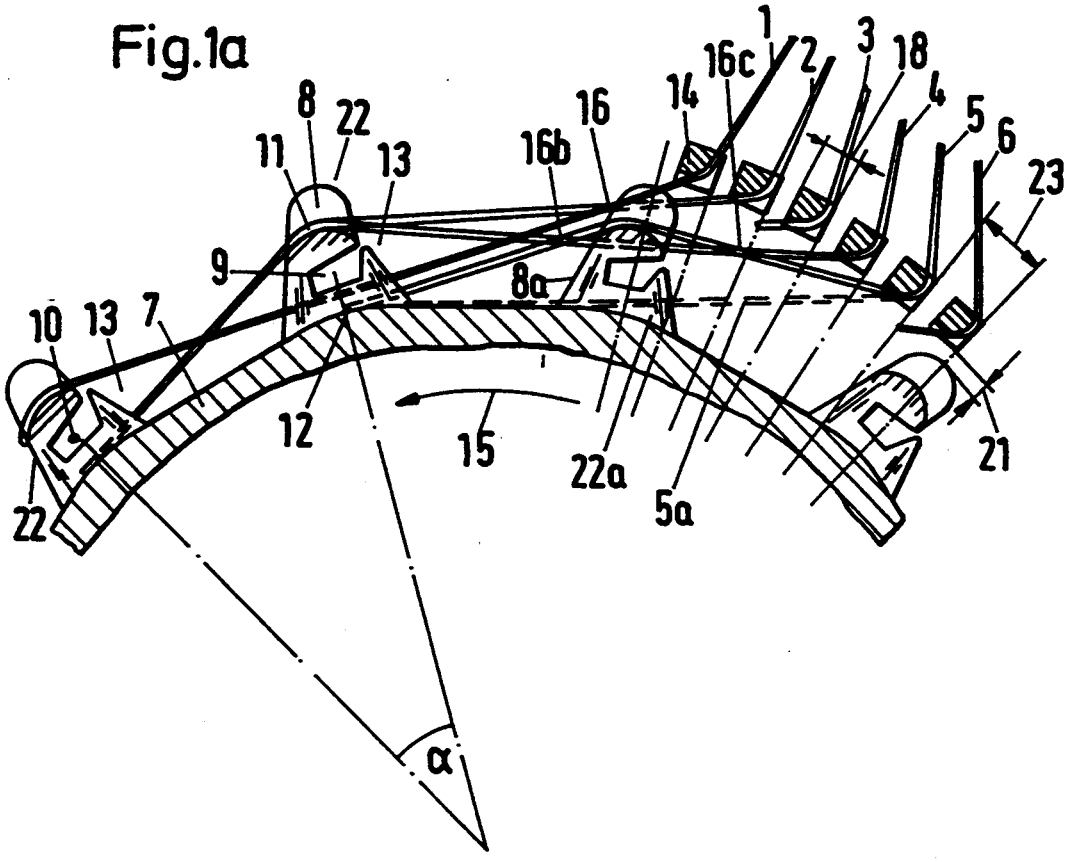
FIG. 1*a* shows a section through a loom rotor and associated laying elements, in which the warp threads between two consecutive guide elements form an intersection point directly in front of an inserted reed.

In FIG. 1*a* a rotor 7 is covered with shedding guide elements 22 in the circumferential direction. The reeds 8 may also be used to beat-up the picks 10 at a fabric knock-off, depending on the design of the guide elements 22. The guide elements 22 also comprise high guides 11 and low guides 12, into which one warp thread or several warp threads is/are laid in by the laying elements 14. In the guide element 22 there is also integrated a pick channel 9, through which the pick 10 can be inserted into the shed 13 between the warp threads 1–6 kept open by the high guide 11 and the low guide 12.

The reed spacing angle $\alpha$, which also corresponds to the spacing angle of the guide elements 22, is an integral fraction of 360°, i.e. 30°. To insert several picks 10 simultaneously, several sheds 13 are formed by guide elements 22. The laying elements 14 are disposed on the periphery with a spacing in the order of magnitude of several reed spacing angles $\alpha$ starting from the knock-off in the direction opposite to the direction of rotation 15 of the rotor 7.

The individual laying elements 14 are disposed parallel to the axis of the rotor 7 by a mutual spacing 23 in the direction of rotation 15 of the rotor 7, the laying elements 14 having a width 18. If the guide element 22 is also used as a reed or if separate reeds without shedding high and low points are provided between the guide elements 22, in the direction of the axis of the rotor 7 or in the direction of rotation 15, the distance 21 from the laying elements 14 to the highest point of the reeds 8 normally lies within a range of up to and is preferably less than 10 mm. The laying elements 14 are normally disposed along a segment of a circle, the radial center of which corresponds to the center of rotation of the rotor 7. The laying elements 14 may lie parallel to the axis of rotation of the rotor 7 in surfaces formed in a different way, e.g. a surface having a different radial center, or in a plane in which the laying elements 14 are disposed one behind the other.

The laying elements 14 consist of bars with guide holes or with notches having a spacing of integral multiples of the warp thread repeat. A laying element 14, e.g. having warp threads 1, 1', 1'', etc is controlled at right angles to the direction of rotation 15 of the rotor 7 according to a program and the warp threads are laid into holes provided for insertion in guide element 22, in coordination with the rotation of the rotor 7. In the present example the laying elements 14 lay their warp threads alternately into high guides 11 and low guides 12, so that sheds 13 are formed.

The guide elements 22 having reeds 8, high guides 11 and low guides 12, which rotate past the laying elements 14, run into the warp threads 1–6, 1'–6', etc supplied tangentially by the laying elements 14 and comb these threads through in the direction of rotation 15 until they are abandoned by the warp threads in the direction of the fabric knock-off. During the insertion of the guide elements 22 into the warp threads 1–6, 1'–6', etc. the reeds 8 have the task of guiding the warp threads so that the warp threads come to lie in the high and low guides provided.

Figure 1C:
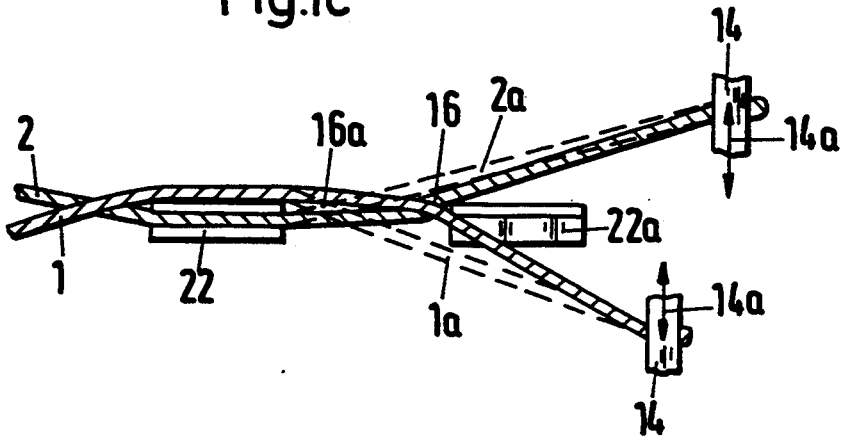
FIG. 1*c* shows a top view of the rotor and also the path of the crossing warp threads.
Figure 1B:
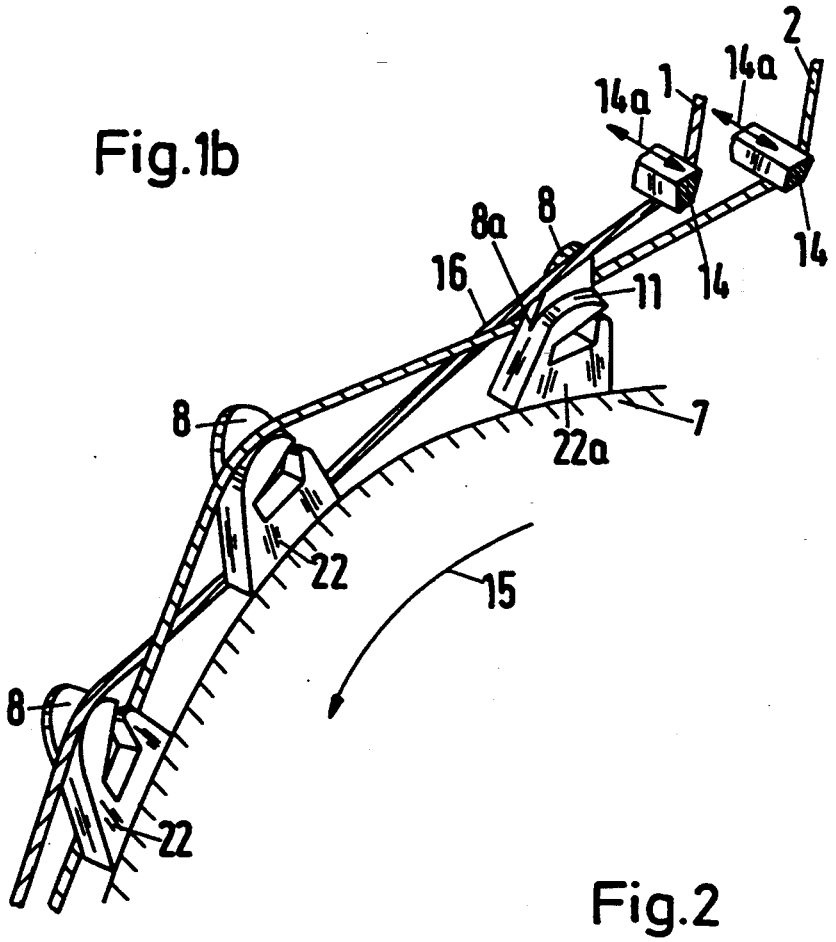
FIG. 1*b* shows a perspective view of the guide elements and of the crossing warp threads.

During the insertion of the warp threads, two warp threads, e.g. the adjacent warp threads 1 and 2 in FIG. 1*b*, form a point of intersection 16 by mutual contact. The warp threads 1, 2 normally inserted in the stretched condition between guide element 22 and laying element 14 into the rotor 7 have an additional bending point at the point of intersection 16, which hinders the freedom of movement of the warp threads 1 and 2, in particular in the direction of movement 14*a* of the laying elements 14. The freedom of movement of the warp threads is restricted thereby, in a manner which partly could not be foreseen, as a result of which there is the danger that the warp threads do not come to lie in the high and low guides provided.

FIG. 1*c* shows the same situation as FIG. 1*b* in a top view of the rotor 7. The warp threads 1 and 2, which touch one another, may have an additional bending point at the point of intersection 16, which is more or less marked, depending on the mutual friction. If the warp threads did not touch one another, they would lie as shown in position 1*a*, shown by broken lines, and an intersection point 16*a* would be produced.

With the point of intersection 16, the freedom of movement of the warp threads 1 and 2 in the direction of movement 14*a* of the laying components 14 is considerably restricted in comparison with point of intersection 16*a*. The guide points provided for the warp threads 1 and 2 are the laying elements 14 and also the guide element 22, into the high and low guides 11, 12 of which the warp threads 1 and 2 have already been inserted. The excursion of any sections of the warp threads 1 and 2 between guide element 22 and laying element 14 in direction 14*a* is calculated according to geometric principles. By intersection point 16 the freely moveable length of the warp threads 1 and 2 with respect to laying element 14 in direction 14*a* is reduced. The closer a touching intersection point 16, in relation to the free length of movement of the warp threads 1 and 2 between guide element 22 and laying element 14, comes to lie against the laying element 14, the more pronounced is the deviation of the actual position of the warp threads 1 and 2 from the desired position 1*a*, 2*a*. In particular with a high number of threads in the warp, there is the danger that warp threads which touch one another and obstruct one another are not inserted into the guide element 22 as planned. As seen in FIG. 1*c*, if the mutual contact of adjacent warp threads at a point of intersection 16 cannot be prevented, a positive effect on the freedom of movement in the direction 14*a* is attained if the point of intersection 16 between laying element 14 and guide element 22 is moved as close as possible to the guide element 22.

There is also the danger that the two warp threads 1 and 2 rub against one another at contact point 16 and such frictional forces are produced that the warp threads 1 and 2 can not be combed out, but are raised from the edge 8*a* of the reed 8 acting on intersection point 16, and intersection point 16 slips over the highest point of the reed 8 into the following space between two guide elements 22. The warp threads 1 and 2 are thus incorrectly inserted into the high and low guide.

From FIG. 1*a* can be seen a further problem of crossing warp threads. The warp thread 4 lies at the high point 11 of guide element 22. The warp thread 5 would lie in position 5*a* shown by broken lines in the absence of inserted guide element 22*a* and would therefore not cross the warp thread 4 between laying element 14 and guide element 22. The guide element 22*a* dipping into the warp threads 1–6 raises the warp thread 5 and between warp threads 4 and 5 produces two additional intersection points 16*b* and 16*c*, in which however no mutual contact should take place under any circumstances. Intersection point 16*c* in particular lies close to laying components 14, and as a result because of the reverse movement there is the danger that the two warp threads 4 and 5 can touch during laying-in at intersection point 16*c* and can therefore hinder one another.

Figure 2:
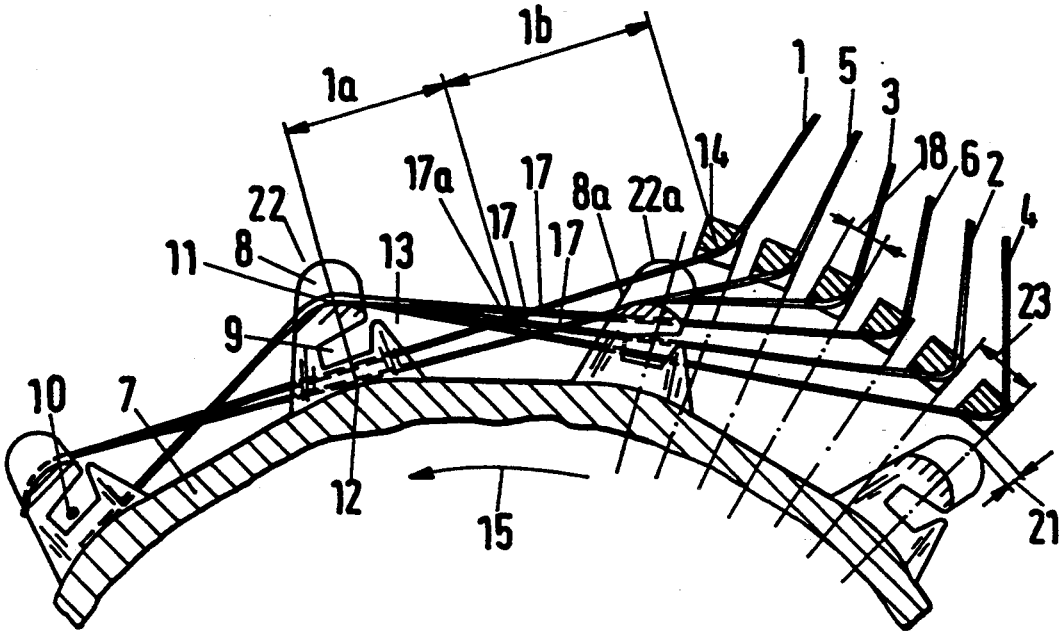
FIG. 2 shows a section according to FIG. 1*a*, in which intersection points displaced forwardly with the laying elements are formed in front of an inserted reed.

In comparison with FIG. 1*a* the warp threads 1–6, which lie next to one another in ascending numbering at right angles to the direction of rotation 15, are distributed differently over the laying element 14 in FIG. 2. The warp thread 2 lying next to the warp thread 1 in the fabric 20 to be produced is inserted into the guide element 22 by a laying element 14 offset by at least one further spacing 23 in the direction opposite to direction of rotation 15 in comparison with FIG. 1*a*. In other words, the warp threads 1 and 2 are engaged by laying elements which are spaced apart by at least one additional laying element, and preferably by more than one additional laying element so that, starting from the point of intersection 16, there is produced a forwardly displaced point of intersection 17*a*, which can be seen in FIG. 2. The remaining warp threads 4–6 also have forwardly displaced points of intersection 17. The properties of a forwardly displaced point of intersection 17 are briefly illustrated by means of the warp threads 1 and 2. The piece of thread 1*b* lying between laying element 14 and the forwardly displaced point of intersection 17*a* is relatively long when compared with FIG.

1a with point of intersection 16, whereas the piece of thread 1a lying between point of intersection 17a and the following guide element 22 is relatively short. According to geometric principle this arrangement, with warp threads 1 and 2 which did not originally touch, permits a greater excursion 14a of the laying elements 14, until the warp threads 1 and 2 touch. A forwardly displaced point of intersection 17a influences the deviation of the warp threads from the specified position less strongly than a point of intersection 16 when there is mutual contact between the warp threads 1 and 2.

With an inserted guide element 22a there is the danger, as already mentioned, that a touching point of intersection 16 can not be combed out and skips the reed 8. A forwardly displaced intersection point 17 reduces the angle of rotation of the rotor, which is required to lay the respective warp threads completely in the high and low guides of guide elements 22. Furthermore a forwardly displaced intersection point 17 normally lies lower down between the inserted guide element 22a and the advancing guide element 22, or alternatively closer to the surface of the loom rotor 7. The inserted reed 8 may therefore dip further into the warp threads 1–6, until it encounters a forwardly displaced intersection point 17, which possibly exists. Therefore a greater force is required to raise an intersection point 17 along edge 8a of a reed 8 over the highest point of the reed. The risk of a reed 8 being skipped is therefore reduced and therefore yarn with a rougher surface can also be safely combed out.

Figure 3:
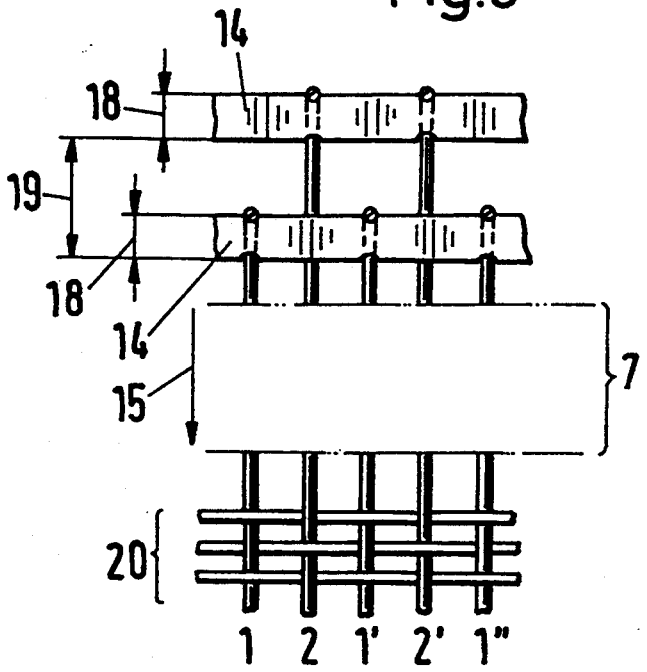
FIG. 3 shows the spacings of the laying elements in the direction of rotation with a 2 thread repeat and forwardly displaced intersection points.

In FIG. 3 is shown an arrangement of the laying elements 14 and also of the warp threads 1–2, 1'–2', 1''—etc accordingly influenced thereby for a basket weave. For this type of weave forwardly displaced intersection points 17, for example, can be produced with an arrangement as shown in FIG. 3 The warp threads 1–2, 1'–2', 1''—etc. lie in two laying elements 14, the laying elements being spaced by at least one minimum pitch 19. The minimum pitch 19 is selected so that, for example, it corresponds to at least twice the width 18 of a laying element 14 in the direction of rotation 15. The forwardly displaced point of intersection 17 may of course be further forwardly displaced by the insertion of guide element 22 in the direction of rotation 15, by the spacing between the two laying elements 14 being increased beyond the minimum pitch 19. As a result the distance from the intersection point 17 to the surface of the rotor 7 is also by necessity reduced.

Figure 4:
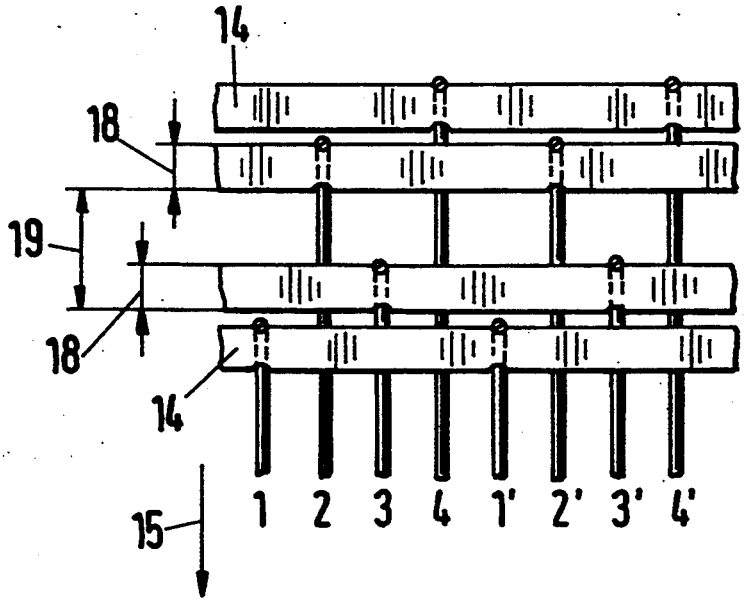
FIG. 4 shows the spacings of the laying elements in the direction of rotation with a 4 thread repeat and forwardly displaced intersection points.

FIG. 4 shows an arrangement of the laying elements 14 and the associated warp threads 1–4, 1'–4', etc for a warp thread repeat of 4 threads. With this arrangement the laying elements 14 can be disposed extremely compactly in direction of rotation 15 so that two warp threads adjacent in the fabric 20 have a forwardly displaced intersection point 17 with a minimum pitch 19.

Figure 5:
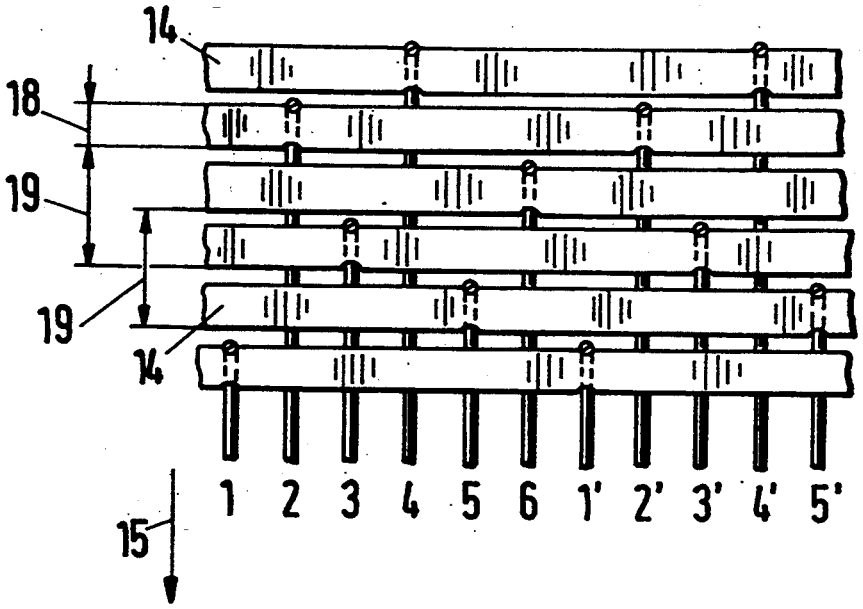
FIG. 5 shows the spacings of the laying elements in the direction of rotation with a 6 thread repeat and forwardly displaced intersection points.

FIG. 5 shows an arrangement of the laying elements 14 and the associated warp threads 1–6, 1'–6', etc for a warp thread repeat of 6 threads. With this arrangement the laying elements 14 can be disposed next to one another in an extremely compact and space-saving manner in the direction of rotation 15 so that two warp threads adjacent in the fabric 20 lie on laying elements having a spacing of at least one minimum pitch 19, and because of this the warp threads have a forwardly displaced intersection point 17.

Of course forwardly displaced intersection points 17 may also be achieved in that the laying elements 14 have the same appropriate spacing in the direction of rotation. FIG. 3 to FIG. 5 show advantageous arrangements of laying elements 14 and warp threads which enable, with forwardly displaced intersection points 17, all the laying elements to be disposed in an angular region which is as small as possible with respect to the direction of rotation 15 of the loom rotor 7.

Figure 6:
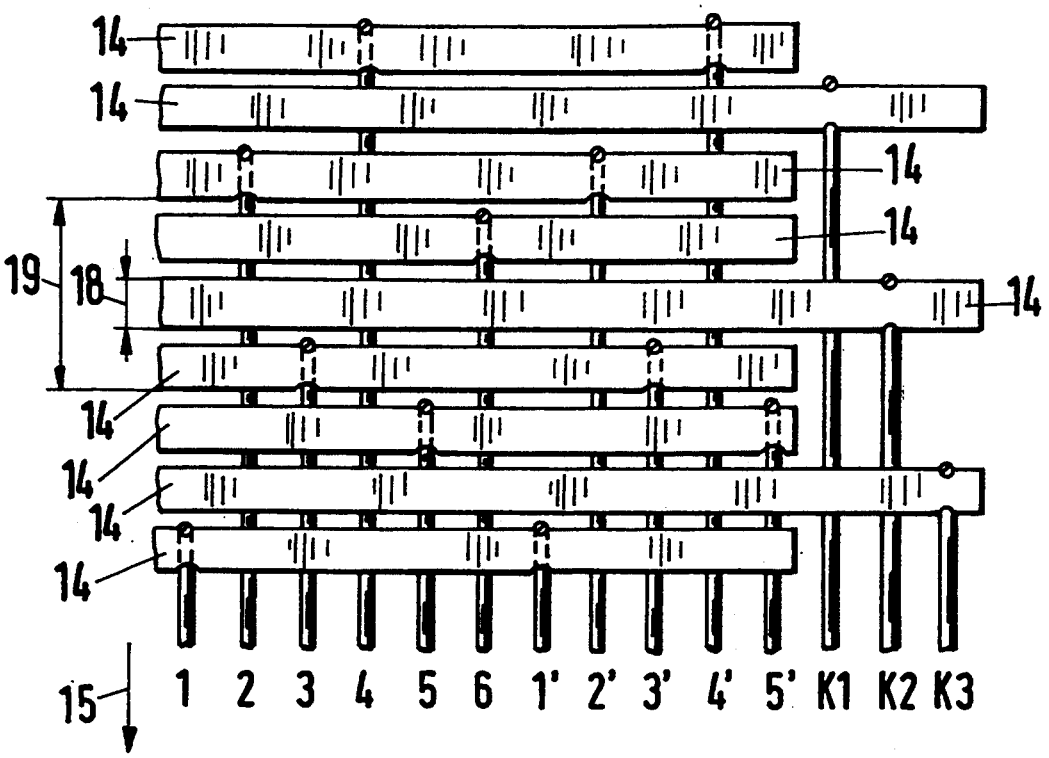
FIG. 6 shows the arrangement of laying elements and warp threads at the edge of a fabric in order to form a list.

The edge of a fabric is normally designed as a list, whereby the list has a weave which is different when compared to the remaining fabric. For a warp repeat of six threads FIG. 6 shows an arrangement of the laying elements 14 and the associated warp threads 1–6, 1'–5' and also the associated selvedge warp threads K1, K2, K3.

Each selvedge warp thread K1, K2, K3 lies separately on a laying element 14, so that the selvedge warp threads K1, K2, K3 can be moved independently of the other warp threads 1–6. All adjacent warp threads, including the selvedge warp threads, have a minimum pitch 19, for which reason the warp threads 1–6, K1, K2, K3 have forwardly displaced intersection points 17.

Figure 7:
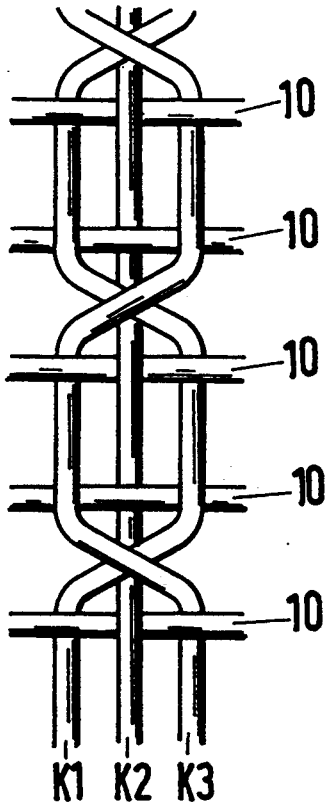
FIG. 7 shows a list with half twist.

FIG. 7 shows an example of a list, consisting of three warp threads K1, K2, K3, whereby these are inserted into the guide elements 22 in such a way that a list, consisting of crossing threads K1, K3 and a stationary thread K2, is formed.

We claim:

1. A series-shed loom for weaving a fabric comprised of warp threads and weft threads, the loom comprising:
   - at least three warp threads to be woven into the fabric so that at least two of the warp threads are adjacent to each other in the fabric;
   - a rotor having reeds for combing through the warp threads, the rotor having a direction of rotation;
   - guide elements on the rotor and defining high points and low points; and
   - laying elements mounted on the loom configured and positioned to guide the warp threads and insert them in the high and low points of the guide elements, the laying elements being spaced from the rotor surface, the laying elements having a width in the direction of rotation and guiding the warp threads so that they extend from the laying elements generally in the direction of rotation towards the guide elements, the at least two warp threads are arranged in the laying elements to be guided over laying elements which are separated from each other by at least the width of two laying elements so that a point of intersection between the warp threads which are adjacent in the fabric is moved relatively further away from the laying elements in the direction of rotation than would be the case if the at least two warp threads were guided over laying elements which are adjacent to each other.

2. A series-shed loom according to claim 1 including at least one additional laying element disposed between the laying elements for the warp threads which are adjacent to each other in the fabric.

3. A series-shed loom according to claim 2 including a plurality of additional laying elements disposed between the laying elements for the warp threads which are adjacent to each other in the fabric.

4. A series-shed loom according to claim 1 wherein a spacing between the laying elements and the reeds is less than 10 mm.

5. A series-shed loom according to claim 1 wherein the laying elements are disposed in a plane.

6. A series-shed loom according to claim 1 wherein the laying elements are formed to engage the warp threads in the high and low points of the guide elements, the laying elements for the warp threads being spaced apart so that the warp threads which are adjacent in the fabric cross each other at a point of intersection which is located relatively farther away from the laying elements than from the guide elements.

7. A series-shed loom according to claim 1, including an additional warp thread for positioning at an edge of the fabric and an additional laying element for inserting the additional warp thread into a corresponding guide element so that a list comprising cross threads and stationary threads is formed.

8. A series-shed loom for weaving a fabric comprised of warp threads and weft threads, the loom comprising:

at least three warp threads to be woven into the fabric so that at least two of the warp threads are adjacent to each other in the fabric;

a rotor having reeds for combing through the warp threads, the rotor having a direction of rotation;

guide elements on the rotor and defining high points and low points; and a multiplicity of elongated, parallel laying elements mounted on the loom and extending parallel to an axis of rotation of the rotor, the laying elements being configured and positioned to guide the warp threads and insert them in the high and low points of the guide elements, the laying elements being spaced from each other to define gaps between them through which the warp threads extend, the at least two warp threads are arranged in the laying elements to be guided over respective laying elements which are spaced from each other by at least one additional laying element located between said respective laying elements so that a point of intersection between the warp threads which are adjacent in the fabric is moved relatively further away from the laying elements than would be the case if the at least two warp threads were guided over the laying elements which are adjacent to each other.

9. A series-shed loom for weaving a fabric comprised of warp threads and weft threads, the loom comprising:

at least three warp threads to be woven into the fabric so that at least two of the warp threads are adjacent to each other in the fabric;

a rotor having reeds for combing through the warp threads, the rotor having a direction of rotation;

guide elements on the rotor and defining high points and low points; and laying elements mounted on the loom and configured and arranged to engage the warp threads and insert them in the high and low points of the guide elements, the laying elements for the two warp threads being spaced from each other so that the at least two warp threads cross each other at a point of intersection which is located relatively farther away from the laying element than from the guide element.

10. In a series-shed loom for weaving a fabric comprised of warp threads and weft threads, the loom including a rotor having reeds for combing through the warp threads and having a direction of rotation, guide elements on the rotor and defining high and low points, laying elements mounted on the loom which are configured and positioned to guide the warp threads and insert them in the high and low points of the guide elements, adjacent laying elements having a given spacing between them and guiding the warp threads so that they extend from the laying elements generally in the direction of rotation of the guide elements, and at least three warp threads at least two of which are adjacent to each other when woven into the fabric, the improvement comprising the at least two warp threads are arranged in the laying elements to be guided over non-adjacent laying elements which are separated from each other by at least two given spacings so that a point of intersection between the at least two warp threads is moved relatively farther away from the laying elements in the direction of rotation than would be the case if the warp threads were guided over adjacent laying elements.

* * * * *